United States Patent [19]

Somerville et al.

[11] Patent Number: 4,586,893

[45] Date of Patent: May 6, 1986

[54] CONTROL APPARATUS

[76] Inventors: Michael J. Somerville; Ian F. Pollard; William J. Walker, all of 25 North Street, Lewes, East Sussex, England, BN7 2PE

[21] Appl. No.: 699,741

[22] Filed: Feb. 11, 1985

Related U.S. Application Data

[62] Division of Ser. No. 446,990, Dec. 6, 1982, abandoned.

[30] Foreign Application Priority Data

Dec. 8, 1981 [GB] United Kingdom ..... 8137016
Aug. 10, 1982 [GB] United Kingdom ..... 8222984

[51] Int. Cl.[4] ..... F23N 5/00

[52] U.S. Cl. ..... 431/76; 123/440; 123/489

[58] Field of Search ..... 431/76; 123/440, 489

[56] References Cited

U.S. PATENT DOCUMENTS 3,657,524 4/1972 Bakke ..... 364/149
4,070,608 1/1978 Rosshirt et al. ..... 364/169
4,130,095 12/1978 Bowler et al. ..... 60/276
4,201,937 5/1980 Irie ..... 318/573
4,373,501 2/1983 Rado ..... 123/589
4,396,369 8/1983 Kaessmann ..... 431/76
4,439,825 3/1984 Donner ..... 364/183

FOREIGN PATENT DOCUMENTS 1573897 8/1980 United Kingdom .

OTHER PUBLICATIONS

"Learning Control of Valve Actuators in Direct Digital Control Systems", *Instrument Society of America,* 22nd ISA Conf., Sep. 11-14, 1967, Preprint 31-3-ACOS-67.

*Primary Examiner*—Carroll B. Dority, Jr.
*Attorney, Agent, or Firm*—Roylance, Abrams, Berdo & Goodman

[57] ABSTRACT

The invention is particularly applicable to combustion control apparatus for burners, having a motor-controlled fuel value, and a motor-controlled damper. Coarse control of the damper position is provided by a mechanical profiler, and a trim motor provides fine control of the damper. Overall, the air or fuel is controlled continuously by an up to the minute control signal corresponding to the instantaneous burn rate.

13 Claims, 11 Drawing Figures

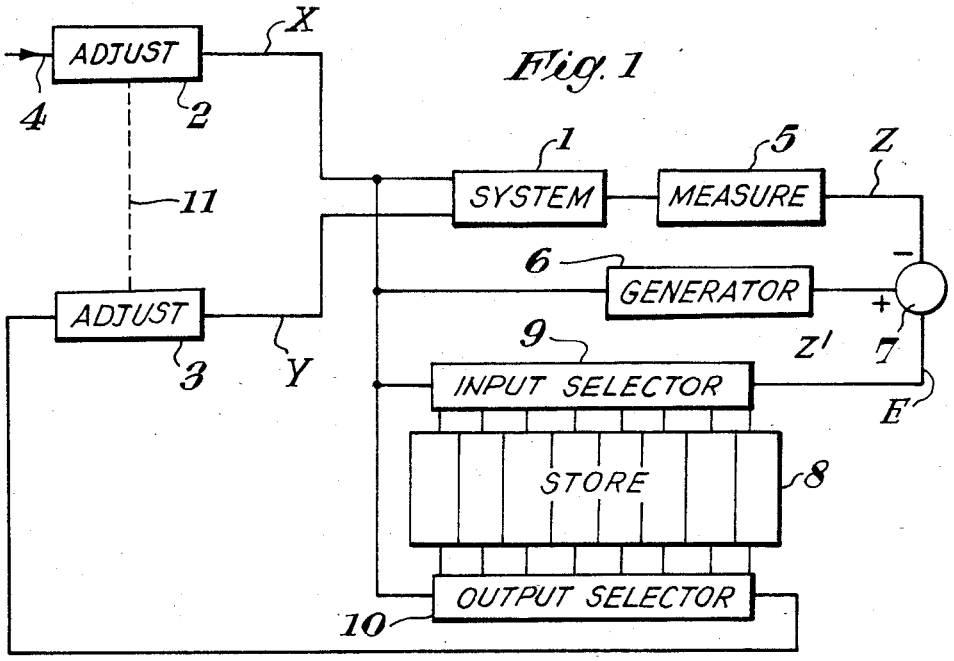
Fig. 1
PRIOR ART
Fig. 2
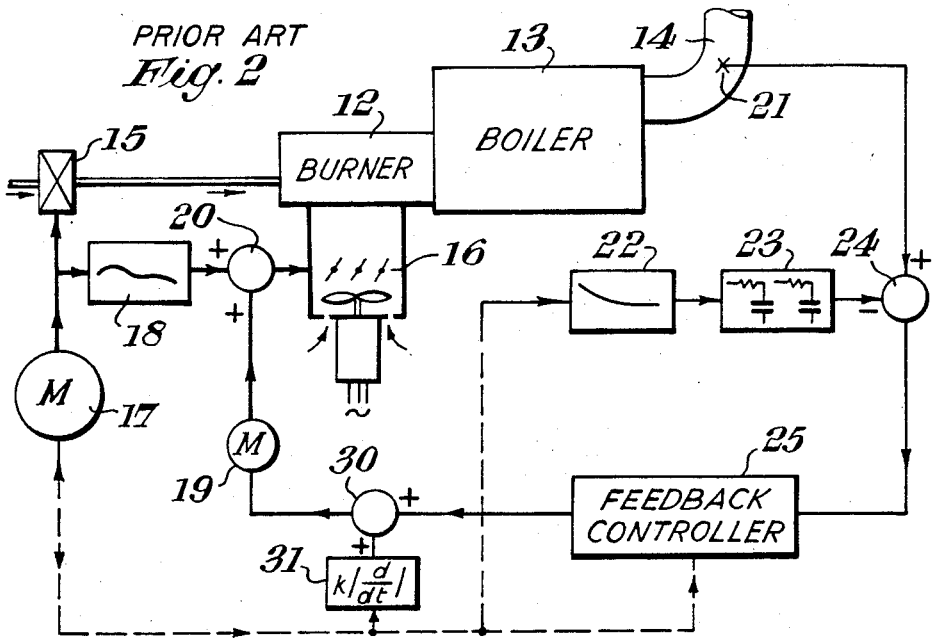

CONTROL APPARATUS

This is a division of application Ser. No. 446,990 filed Dec. 6, 1982, now abandoned.

This invention relates to control apparatus for systems having means for adjusting first and second operating variables, and means for measuring a characteristic of the system resulting after a time-delay from the actual values of said first and second operating variables.

The first variable may be controlled manually or by a control signal generated in an external system and the control apparatus may function to control the second variable so that it follows changes in the value of the first variable in such a way that the measured characteristic has some particular fixed or variable value.

An example of such a system is a burner in which the first operating variable is the fuel supply, the second operating variable is the air supply, and the characteristic measured is the oxygen content of the flue gas. Accordingly, the invention is particularly applicable to combustion control apparatus but is not limited thereto.

In a system of the kind with which the invention is concerned, it is known to compare the measured value of the characteristic with a desired value to produce an error signal, and to control the second variable in dependence on said error signal. However, because of the delay in the changes of said characteristic in response to changes in said first and second operating variables, known systems tend to be inefficient in that they cannot operate to maintain the actual value of the characteristic close to the desired value at all times.

Accordingly, it is an object of the invention to provide control apparatus which responds more quickly than known control apparatus, and can therefore maintain the actual value of the characteristic of the system closer to the desired value than in known systems.

From one aspect the invention consists in control apparatus for a system having means for adjusting first and second operating variables of the system, and means for measuring a characteristic of the system resulting after a time delay from the actual values of said first and second variables; said apparatus comprising means for comparing the measured value of said characteristic with a desired value and producing an error signal representing the difference between said measured value and said desired value; means for storing a plurality of control signals each representing a value of said second variable associated with a respective value of said first variable and for continuously updating said control signals by varying them in dependence on said error signal in the direction necessary to reduce said error signal towards zero; means for continuously selecting the appropriate control signal in dependence on the instantaneous value of said first variable; and means controlled by said selected control signal for changing said second variable in the direction necessary to reduce said error signal towards zero.

In many systems, the desired value of the characteristic will vary non-linearly with variations in the value of the first variable. Accordingly, such systems will include a desired value generator controlled by the first variable. In such systems, the value of the second operating variable required to maintain the characteristic at the desired value will also vary non-linearly with changes in the first variable. Accordingly, means may be provided to effect a coarse control of the second variable in dependence on changes in the first variable, and control apparatus in accordance with the invention may be used merely to add a fine control signal to the coarse control signal in order to correct for inaccuracies of the coarse control signal.

One method of performing this first aspect of the invention will now be described with reference to FIG. 1 of the accompanying diagrammatic drawings. This Figure shows a system 1 having means 2 and 3 respectively for adjusting operating variables X and Y of the system. An input signal 4 controls the adjusting means 2, while control apparatus in accordance with the invention is provided to control the adjusting means 3.

A measuring device 5 is provided to measure a characteristic Z of the system resulting after a time-delay from actual values of the variables X and Y. A generator 6 produces an output signal Z′ representing a desired value of the characteristic Z. This generator is controlled in dependence on the value of the first variable X, and the output Z′ has a predetermined non-linear relationship to the input X. The measured value of Z is compared with the desired value Z′ in a comparator 7 to produce an error signal E representing the difference between the values of Z and Z′.

A storage system 8 having eight individual storage locations is provided to store eight control signals each representing a value of the variable Y associated with a respective value of the variable X. These control signals are continuously updated by means of the error signal E in the direction necessary to reduce the value of E towards zero. For this purpose, an input selector 9 is controlled by the value of the variable X to allocate the error signal E to that one of the storage locations containing the control signal representing the value of Y associated with the instantaneous value of X. Since there is a finite number of storage locations, (in the particular example being considered—8) the selector 9 operates to allocate the error signal to two adjacent storage locations whenever the instantaneous value of X is not exactly that associated with any one of the storage locations. Preferably the arrangement is such that the proportion of the error signal supplied to each of the two adjacent storage locations depends on the distance of the instantaneous value of X from the centre values associated with the two adjacent storage locations.

Similarly an output selector 10 is provided to connect the input of the adjusting means 3 to that storage location which is associated with the instantaneous value of X. Again, since the number of storage locations is finite, the output selector 10 operates to allocate proportions of the control signals contained in two adjacent storage locations in dependence on the actual value of X.

It will be seen that, in a system as illustrated in FIG. 1, once the control signals have been built up in all the storage locations, the control apparatus will respond substantially instantaneously to provide a value of Y which is very close to the value required at any value of X to maintain the actual value of the characteristic Z close to the desired value of Z′.

The broken line 11 between the adjusting means 2 and 3 is intended to indicate that coarse control of the variable Y may be provided by the adjusting means 2 in accordance with a predetermined linear or non-linear relationship.

As already stated, the invention is particularly applicable to combustion control apparatus for burners.

Thus from another aspect the invention consists in combustion control apparatus for a burner having a motor-controlled fuel valve and motor-controlled means for adjusting the supply of air to said burner as the burn-rate is varied by said fuel valve, said apparatus comprising means for measuring a characteristic of the flue gas of said burner; means for comparing the measured value of said characteristic with a desired value and producing an error signal representing the difference between said measured value and said desired value; means for storing a plurality of control signals each representing a value of the air supply associated with a respective burn-rate and for continuously updating said control signals by varying them in dependence on said error signal in the direction necessary to reduce said error signal towards zero; means for continuously selecting the appropriate control signal in dependence on the instantaneous burn-rate; and means for applying said selected control signal to adjust the supply of air or said fuel valve in the direction necessary to reduce said error signal towards zero.

Normally the measured characteristic will be the oxygen content of the flue gas, and the desired value of oxygen will vary in accordance with the burn-rate. Accordingly, means will be provided to generate a signal representing the desired oxygen value at each burn-rate. As in known systems, a coarse variation of the air supply may be provided by means of a mechanical profiler controlled by the motor operating the fuel valve in dependence on the desired burn-rate. This mechanical profiler may control a damper or a fan supplying air to the burner. The apparatus in accordance with the invention will then be used to trim the output of the mechanical profiler, and thus provide fine control of the air supply. In an alternative system the apparatus in accordance with the invention is used to provide fine control of the fuel supply instead of the air supply.

Methods of performing the second aspect of the invention will now be described with reference to FIGS. 2 to 12 of the accompanying diagrammatic drawings, in which:

FIG. 1 shows an overall logic block diagram of the present invention;

FIG. 2 represents a conventional combustion control apparatus;

Figure 3:
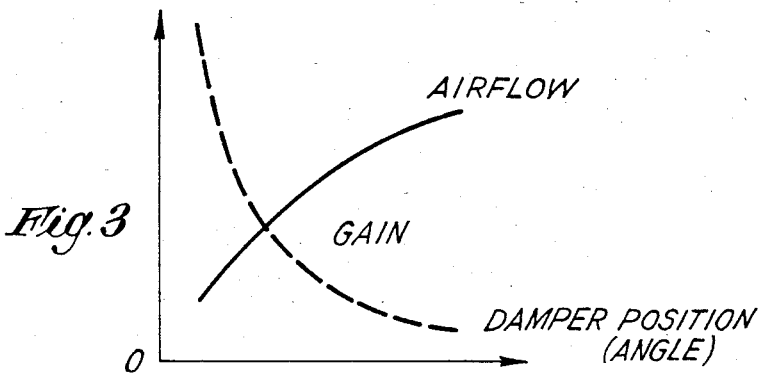
FIG. 3 illustrates a typical damper characteristic.

The conventional system illustrated in FIG. 2 includes a burner 12 heating water in a boiler 13, and having a flue 14. The fuel supply to the burner is controlled by a fuel valve 15, and the air supply to the burner is controlled by a damper 16. The fuel valve 15 is controlled by a motor 17 in dependence on a burn-rate demand signal, and the position of the damper 16 is controlled by a mechanical profiler 18 and a trim positioner 19. The mechanical profiler provides coarse control of the damper position in dependence on the burn-rate demand signal, while the trim positioner 19 adds a fine control signal in a mechanical mixer 20.

A sensor 21 is provided in the flue to measure the percentage of oxygen in the flue gas. An optimum value of the oxygen contained is generated in the generator 22. This is controlled by the burn-rate demand signal to provide an output signal which varies in accordance with a predetermined non-linear relationship in dependence on the burn-rate. This signal is applied through a loop-response lag compensating circuit 23 as one input to a comparator 24. The other input to the comparator 24 is constituted by the oxygen measurement so that the output from the comparator consists of an error signal representing the difference between the actual value of the oxygen content of the flue gas and the desired optimum value. The error signal is applied to a feedback controller 25 which also receives the burn-rate demand signal to provide loop-gain compensation. The output of the feedback controller is supplied to the trim positioner 19. Preferably a further signal is added to the output of the feedback controller to modify the input to the trim positioner in dependence on the modulus of the rate of change of the burn-rate demand signal, so as to ensure that there will be excess air during changes in burn rate to avoid transient generation of smoke.

In practice, the burn-rate demand signal, which will normally be the control signal within a control loop for raising steam or hot water, will change continually from one lever to another at a rate limited only by the response speed of the burn-control motor 17. This motor may, for example, take only about 10 secs to run from minimum burn-rate to maximum.

Because of the need for flame trap and soot filters, the oxygen-measuring sensor 21 has a response lag which may be as great as 20 secs. There is a further lag in the boiler itself between changes in the air supply and changes in the oxygen content of the flue gas. Thus the control loop illustrated in FIG. 2 will be sluggish in response relative to the expected rates of change in the burn-rate demand, giving rise to problems of incorrect, and therefore inefficient, burning possibly with soot emission. Such incorrect burning will normally occur during transient response from one burn-rate to another and, since the changes in burn-rate demand are normally continuous, the reduction in net efficiency can be significant. The inclusion of the modulus of rate of change of input burn-rate demand signal referred to above gives some improvement by permitting operation without soot formation, but is not capable of being by any means fully-effective.

As can be seen from FIG. 3, the variation of the air flow with damper position has a non-linear characteristic which imposes a gain characteristic as shown. Compensation is achieved by varying the gain of the controller against burn rate with a characteristic inverse to that shown in FIG. 3.

Figure 4:
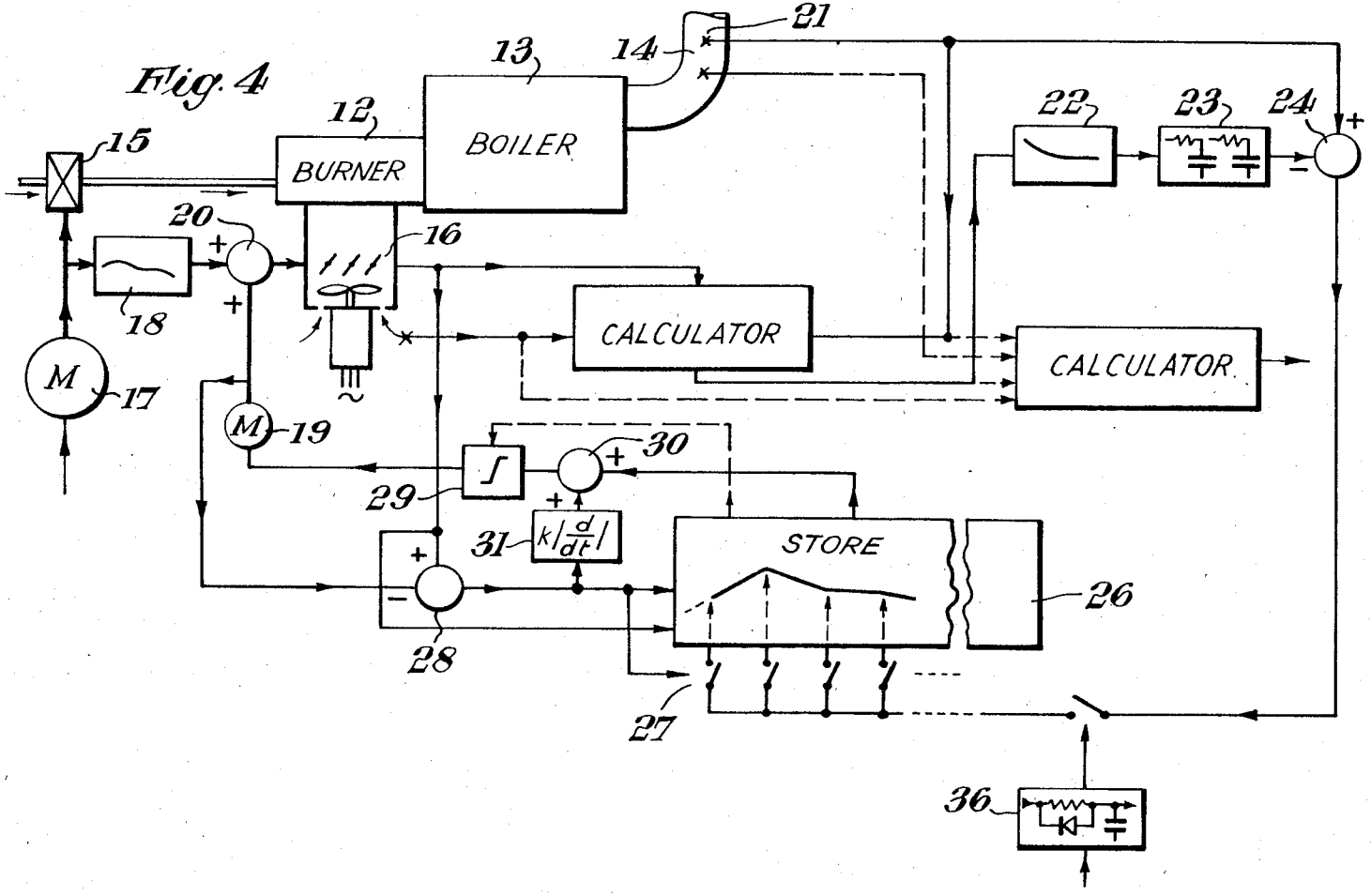
FIG. 4 shows control apparatus in accordance with the invention.

A system in accordance with the invention is illustrated in FIG. 4, and it will be seen that the main characteristic of this system is that the feedback controller 25 is replaced by an adaptive trim controller 26. This device overcomes the response lag problems inherent in the conventional system by building up an electronic profile for trim position versus burn-rate. Following a short initial period of trim adaption, the required trim position is achieved with very quick response by direct feedforward of the values stored in the adaptive trim controller.

The controller 26 is basically similar to the storage system 8 illustrated in FIG. 1 and consists of a number of individual storage locations, each adapted to store a value of the trim position required for a particular value of burn-rate. The stored values are continuously updated by means of the error signal from the comparator 24. This signal is passed through a control selection device 27 which is similar to the input selector 9 of FIG. 1. The controller also includes an output selector which is not separately illustrated in FIG. 4, but, as in the arrangement illustrated in FIG. 1, this selector again operates to feed the output from the correct storage location to the trim positioner 19.

In the particular system illustrated in FIG. 4, the electronic profile build-up in the controller 26 is related to the output of the mechanical profiler 18 rather than to the actual burn-rate demand signal. As in the known system, this output bears a predetermined non-linear relationship to the burn-rate demand signal. In practice, it is also convenient to reconstruct this output by subtracting the output of the trim positioner 19 from a signal measuring the actual damper position, and this is done in the comparator 28. The input to the controller 26 is derived from the damper position minus trim position rather than taking the damper position alone in order to avoid possible positive feedback effects during build-up of the effective trim profile.

A calculator 51 receives input signals representing the actual position of the damper 16, the inlet air temperature and the oxygen content of the flue gas. As one of its outputs the calculator 51 provides a signal representing the burn-rate demand which is applied to the generator 22, as in the case of the system illustrated in FIG. 2.

A calculator 52 which is not concerned with the mode of operation of the system in accordance with the present invention, receives signals representing the burn-rate demand, the oxygen content of the flue gas, the flue temperature and the air inlet temperature, and performs an efficiency calculation to control a display.

It is, of course, to be understood that control apparatus in accordance with the invention could be used to control the damper position directly without involvement of the mechanical profiler 18. However, in most cases, safety considerations make the trim system of FIG. 4 preferable.

It is to be understood that the trim-gain of the system illustrated in FIG. 4 is the incremental slope of the damper characteristic divided at each point by the airflow. Thus a constant incremental gain would be obtained if the damper has a square-law characteristic. However, the damper characteristic normally has the reverse non-linear shape shown in FIG. 3. Consequently there is a large change in the incremental gain over the full range of damper positions. To compensate for this incremental gain, the inverse characteristic is included in the adaptive trim loop. The working point on the gain characterisitc is determined using the current damper position since this and not the damper minus trim signal, is directly related to the airflow characteristic and hence to loop gain.

For commissioning, the air flow versus damper position characteristic is measured using a flow meter in the flue, and applying flue and inlet air temperature corrections to refer back to burner inlet volumetric air flow.

From the above, it will be seen that the control apparatus in accordance with the invention essentially involves having a number of feedback controllers, each functioning to generate and store the correct trim position control signal for a respective range of outputs from the mechanical profiler 18. As few as eight controllers may be adequate, providing interpolation is arranged as described in connection with the apparatus illustrated in FIG. 1. Preferably these zones cover equal changes of output from the mechanical profiler 18. As the output of the mechanical profiler varies with changes in the demand burn-rate, control of the system passes from one feedback controller to the next. As already explained, the error signal is switched from one feedback controller to the next, thus serving to build-up, and also update, the adaptive trim profile. In practice, the controllers can be integrators, in which case, they also serve as the storage locations.

Changes in burn-rate demand in a system in accordance with the invention directly affect the trim positioner 19, and the response is therefore limited only by the response speed of the trim motor which can be negligible compared with the response of other parts of the system.

Figure 5:
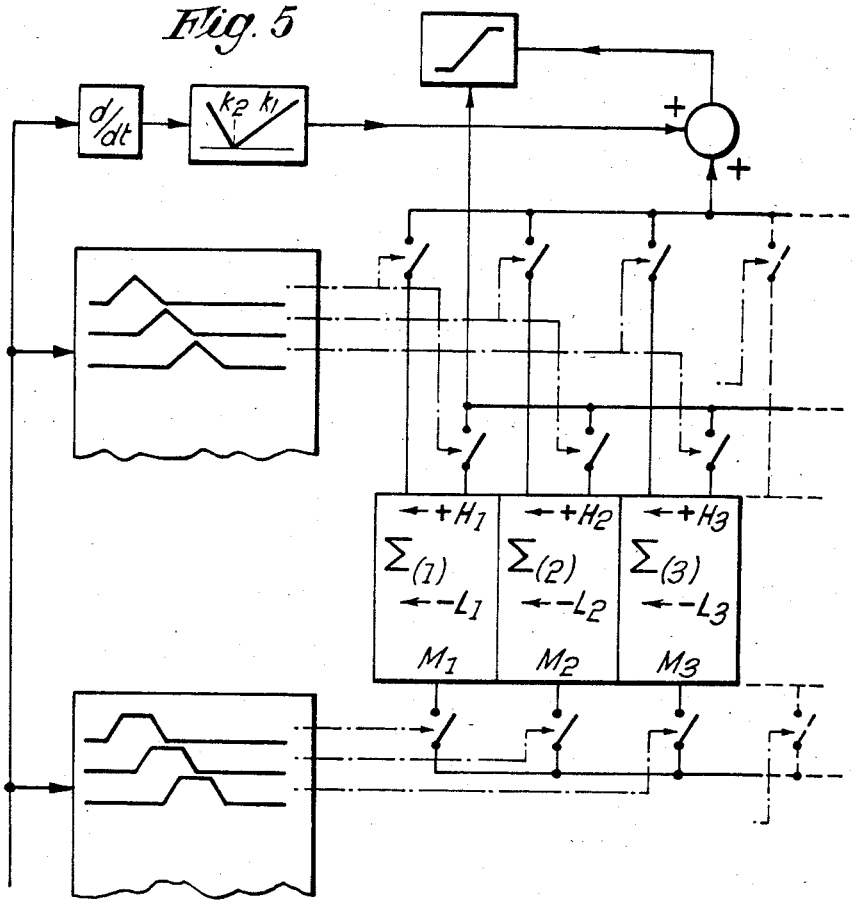
FIG. 5 illustrates a part of the apparatus shown in FIG. 4.
Figure 6:
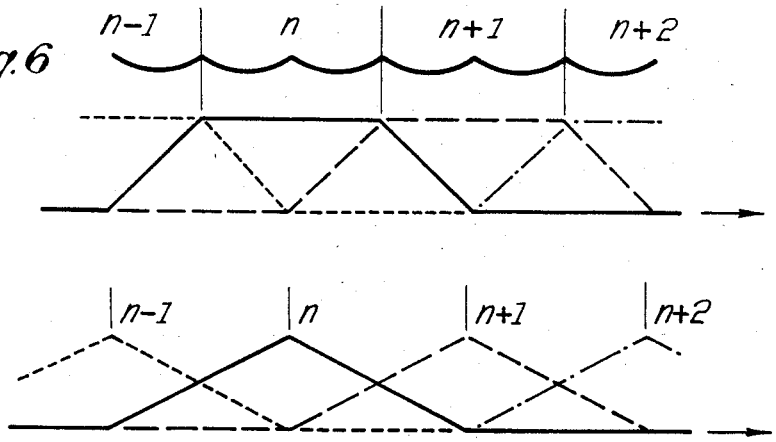
FIG. 6 shows the means for proportioning the inputs and interpolating outputs of the storage system.

One possible form of controller is indicated in FIG. 5. This particular method of implementation uses digital techniques, and is realised by means of a microprocessor. Inputs to the various integrators are proportioned so that two integrators adjacent to the system operating point are updated in proportion to multiplier functions as illustrated in FIG. 6. Thus the proportions of the existing error signal which are used to update the two integrators depend on the closeness of the mid-zone point of each integrator zone to the profiler operating point. If the operating point is, for example, midway between the mid-points of two control zones, each zone is updated equally, and the nett gain through the system remains at unity. To achieve this, the gain of each multiplier remains at unity over ± half of one zone, and drops linearly over the next half zone. Ideally the nett effective gain would be constant over all input levels but, for simplicity, the compromise for the multipliers characteristic as shown in FIG. 6 is acceptable.

In a system in which there are a large number of zones it may become appropriate to extend the proportioning action to simulataneously update more than just the two adjacent zones as in the present system. However, for the relatively small number of zones used in the system being described, the proportioning arrangement indicated is satisfactory.

As in the case of the system illustrated in FIG. 1, means are provided to interpolate linearly between the integrator outputs. The characteristics of the output interpolation multipliers are indicated in FIG. 6.

For safety reasons, it is desirable to provide arrangements for limiting the trim position control signal. The limits to be provided vary in accordance with the burn-rate and, once again, in the present system, the reconstructed output from the mechanical profiler is used to select the limits in the same way as it is used to select the outputs. Also linear interpolation between the limits is effected, the limiter 29 being located immediately in front of the trim positioner 19. The selected output from the controller 26 is passed to the limiter 29 after a modulus of rate of change signal has been included in an adder 30. The modulus of rate of change signal is derived from the reconstructed output from the mechanical profiler in a differentiating circuit 31.

If the trim limits over the full range of burn-rate were required to achieve a constant proportion of oxygen trim ability, in the flue gas, the trim position limits would be directly proportional to the loop-gain values as taken from the damper flow versus position characteristic of FIG. 3. In practice, however, it is likely that trim limits will differ from this direct proportionality because a neutral trim profile is intentionally more oxygen-rich than the optimum burn condition in order to give a safety margin when in manual control.

The use of the adaptive trim control 26 does not in itself remove the transient disturbances caused by changes in the oxygen set point at the output of the function generator 22. Accordingly, compensation is effected in the arrangement shown in FIG. 4 by including the loop-response lag compensating circuit 23 as in the conventional system. A conventional system still has to error respond, whereas, a system in accordance with the invention does not. Residual errors after compensation of this oxygen set point variation effect should, therefore, be small.

Figure 7:
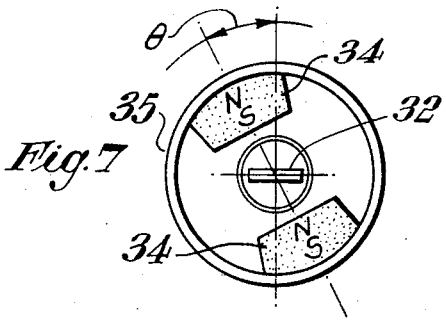
FIG. 7 shows a position sensor which may be used in apparatus in accordance with the invention.

Both the system illustrated in FIGS. 4 and 5, and the conventional system illustrated in FIG. 2, could conceivably be implemented using a velocity drive to the trim positioner 19. Such a system could be attractive because of the poor reliability of known trim motor position transducers which are normally in the form of potentiometers. However a disadvantage with velocity drive is the inability to apply safety limits and to start up from a safe neutral trim position. An economic solution to the problem of achieving reliable position measurement may be obtained through the use of a noncontacting Hall-effect magnetic sensor as illustrated in FIG. 7. Such a sensor comprises a Hall-effect device 32 which is fixed in position. A field-magnet assembly 33 is secured to the shaft of the trim positioner 19 to rotate therewith. The field-magnet assembly includes two permanent magnets 34 secured to a soft iron annulus 35. The magnet assembly provides a magnetic field with a resolved-component normal to the plane of the Hall-effect device which varies approximately linearly with rotation of the trim positioner shaft. Such a device is sufficiently accurate over about ±30° displacement from a central position. A similar device may be used for the measurement of the damper position.

To avoid an initial start-up transient, closure of the adaptive loop needs to be delayed by some 10 to 20 secs after the normal burn signal taken from the burner control unit in order to allow settling of the oxygen sensor 21 which, prior to the initiation of burning, was subjected to purge air. Opening of the adaptive loop, on the other hand, must be immediately upon cessation of burning. This switching is indicated by the "Slow-On/Fast Off" circuit indicated at 36.

Initial start-up of the boiler from cold requires, for safety reasons, that the trim positioner shall initially be in the neutral position. However, during on/off proportioning operation, it is desirable that the adaptive trim profile is retained so that the correct trim position is achieved immediately burning recommences after an off period.

The modulus of rate of change signal provided by the differentiating circuit 31 may be smaller than in the system illustrated in FIG. 2. It is included, preferably with different gains settable for positive or negative rates of change, only as a final refinement to permit operation as near as possible to the ideal oxygen setpoint. This term can allow for slight velocity lag in the trim positioner, and for possible transient effects in the burner. Trim velocity lag on reducing burn-rate would give a fuel-rich effect and, on increasing burn-rate, an oxygen-rich effect. Hence the need for different magnitudes of the term dependent on the sign of the burn-rate change.

A limit to the effectiveness of the apparatus described with particular reference to FIGS. 4 and 5 has proved to be the existence of hysteresis in the mechanical profiler. Accordingly, a method of modifying the apparatus of FIGS. 4 and 5 to remove the effects of hysteresis in the mechanical profiler will be described hereinafter.

Figure 8:
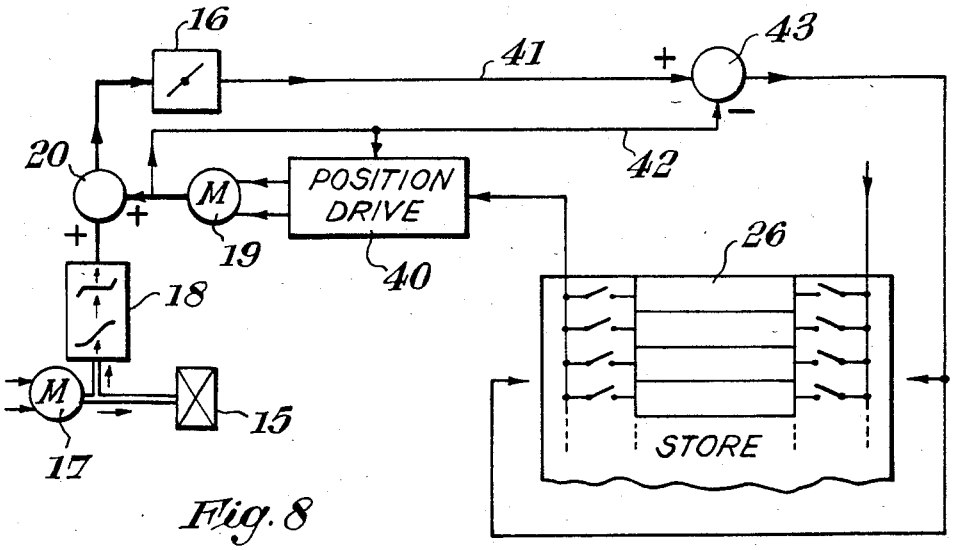
FIG. 8 is a simplified diagram representing the basic layout of the control apparatus illustrated in FIGS. 4 and 5.

The basic layout of control apparatus as illustrated in FIGS. 4 and 5 is shown in FIG. 8. It will be seen that the apparatus illustrated in FIG. 8 includes a burn-rate control motor 17 coupled to a fuel valve 15 and also to a mechanical profiler 18. The mechanical profiler 18 provides coarse control of the damper 16 and fine control of the damper is added by a trim motor 19 through a mechanical mixer 20. The trim motor 19 is controlled by a position drive 40. The input of the position drive 40 is provided by an adaptive trim controller 26. As hereinbefore described, the adaptive trim controller serves to build up an electronic profile for trim position with variations in burn-rate. The particular adaptive trim signal used is selected by a reconstructed signal representing the untrimmed damper position. This signal is reconstructed by subtracting the feedback signal on line 42 representing the position of the trim motor 19 from the signal on line 41 representing the danger position. The circuit contained in the electrical device 43 performs this operation. It will be understood that, in the system illustrated in FIG. 8, the signals provided by the adaptive trim controller 26 represent the desired position of the trim motor and, as a result of the trim position signal feedback to the position drive 40 on the line 42, the trim motor will be moved to, and held in, the position determined by the particular output selected at any instant from the adaptive trim controller. However, because of mechanical sloppiness in the mechanical profiler 18, the damper 16 may move through small angles even when there is no movement of the burn control motor 17 or the trim motor 19. This movement will affect the reconstructed untrimmed damper position signal which is used to select the inputs and outputs of the adaptive trim controller 26 and, if the movements are sufficiently large, will cause changes in the input to which the oxygen error signal is applied and also in the control signal applied to the position drive 40. These changes can give rise to an oscillatory state or, at best, to a low frequency flipping of the damper backwards and forwards around the desired operating position.

Figure 9:
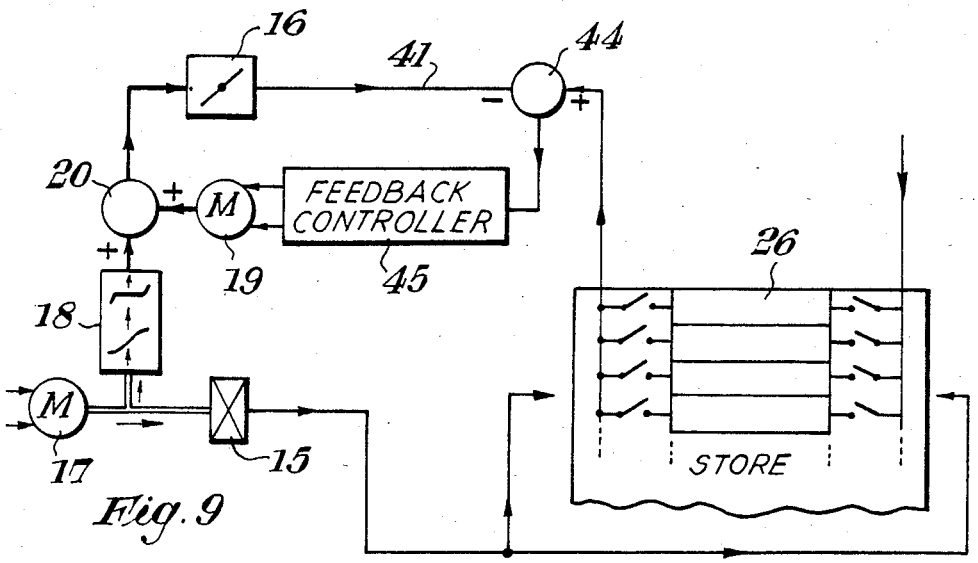
FIG. 9 illustrates a first modification of the apparatus illustrated in FIG. 8.

In the modified arrangement illustrated in FIG. 9, the effect of mechanical hysteresis in the profiler is eliminated by using the controller 26 to store not control signals representing the desired position of the trim motor, but control signals representing the desired position of the damper. In this case, it will be seen that the output from the controller 26 instead of being applied direct to the position drive 40 is applied through an error amplifier circuit 44 to a feedback controller 45. The second input to the error amplifier 44 is provided by the damper position signal on the line 41. Thus, in this case, the system operates to ensure that the actual position of the damper corresponds to the control signal provided by the controller 26. Thus, in this arrangement, the hysteretic sloppiness of the mechanical profiler is closed via a local fast loop. The adaptive loop now creates an ideal electronic profile effectively in parallel with the mechanical profile. It will be seen that the damper position is made to follow the ideal electronic profile. If desired, the trim motor 19 can now be in velocity drive mode.

It is to be understood that, with the arrangement shown in FIG. 9, it is not possible to use the reconstructed untrimmed damper position signal for selecting the integrators of the controller 26 as in the arrangement shown in FIG. 8 since such an arrangement would be unstable. In the FIG. 9 arrangement, accordingly, the integrators are selected by means of a transducer fitted to the fuel valve. This transducer produces a fuel valve position signal which is applied to select the inputs and outputs of the controller 26. Care must, of course, be taken to ensure that there is no dead movement between the fuel valve and the transducer. It should be noted that, in dual fuel systems, a second fuel valve transducer will normally be required to enable the system to remove the hysteresis which would exist also in the second mechanical profiler.

Figure 10:
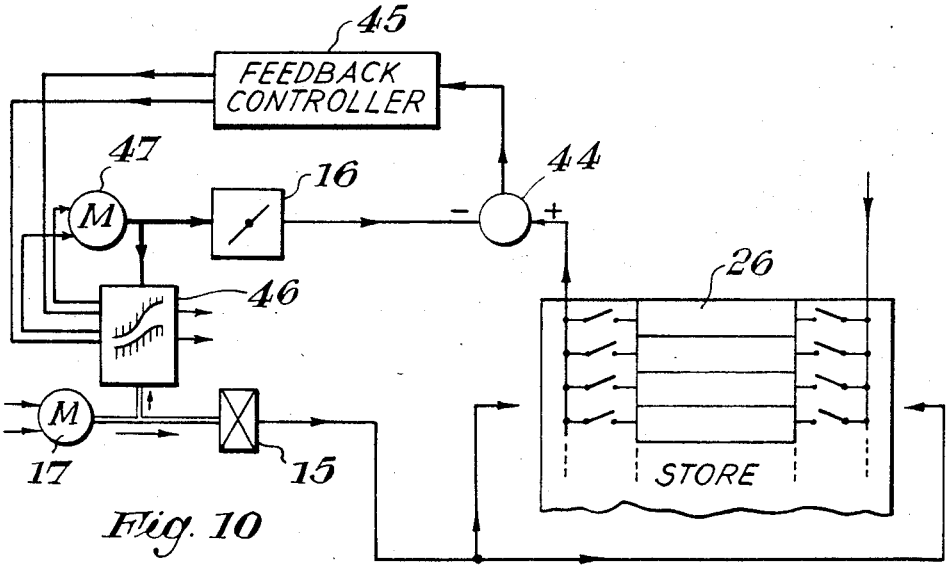
FIG. 10 illustrates a second modification of the apparatus illustrated in FIG. 8.

A further development of the system shown in FIG. 9 is shown in FIG. 10 of the accompanying drawings. In the arrangement shown in FIG. 10, the mechanical profiler 18 is replaced by a limits profiler 46. The trim motor 19 is replaced by a damper motor 47 which controls the damper directly to position it in accordance with the damper position signal from the output of the controller 26. The signals from the feedback controller to the damper motor are passed through limit switches controlled by the limits profiler 46 in order to avoid any possibility of explosive mismatch of the fuel/air ratio. If desired, inner and outer limits may be provided for both high and low levels, the inner limits serving to over-ride the damper motor drive and set the damper to neutral trim position, while the outer limits serve to initiate burner shutdown.

When the mechanical limits profiler 46 is used, it is possible to dispense with the electronic trim limiting 29 shown in FIG. 4 of the drawings. In the alternative arrangement, however, provided safety requirements can be satisfactorily secured, the mechanical limits profiler 46 may be dispensed with and similar results achieved solely by use of the electronic trim limiter.

Another modification of the present invention relates to the multipliers used to apply the input signals to the various integrators of the microprocessor. In accordance with this modification, the multiplier functions illustrated in FIG. 6 for the inputs to the controller are replaced by interpolation functions similar to those used for the output multipliers. With this arrangement, when control is located midway between break points, the loop gain is halved relative to control at a break point. However, because the update when operating midway contains a degree of uncertainty, it is appropriate to update half as quickly at the midway operating point. Simulated tests have shown that convergence to an optimum trim profile is improved by the use of this characteristic.

In accordance with yet another modification, the integrators shown in FIG. 5 are replaced by more sophisticated controllers such as three-term controllers. In fact, these controllers may operate in accordance with any appropriate digital algorithm provided that the steady state part of each controller break point output is held when control moves over to another break point controller.

In accordance with yet another modification, when the reconstructed untrimmed damper position signal is used to control the inputs and outputs of the controller 26, a simulated plant response delay is included in series with this signal. Because of plant response delay, the error signal which is fed in at any time to the controller 26 relates, in fact, to conditions in the plant prevailing at a previous time. Theoretically, therefore, updating of the adaptive profile should be applied to the integrator which was relevant to that previous time. The delay can be introduced, for example, by a simple two element filter.

The arrangement described with reference to FIGS. 4 and 5 operates to cause the burner to operate under such conditions that the percentage of oxygen in the flue gas corresponds as closely as possible to an optimum value of oxygen for any particular burn-rate. If desired, the optimum value of oxygen is generated from a measurement of carbon monoxide or of stack solids in the flue gas. In an alternative arrangement, the system is designed to cause the burner conditions to produce a desired value of carbon monoxide in the flue gas rather than a desired value of oxygen. At the present time, the system based on an optimum value of oxygen content is preferred simply because maintenance-free oxygen probes are more readily available than carbon monoxide or stack solids probes. However, under certain circumstances, if suitable probes become available, carbon monoxide or stack solids measurements may be preferable to oxygen measurements. One of the disadvantages of using oxygen measurement is related to air leaks. However, it is to be noted that sampling from the centre of the flue largely obviates errors due to air ingress.

The basic system of FIG. 1 has means for adjusting first and second operating variables and includes means for producing a plurality of control signals, each representing a value of the second variable associated with a respective value of the first variable. In an extension of this basic system, a number of pluralities of control signals are produced, each plurality being associated with a respective value of a third variable. This third variable may be one which is adjusted by external control, or it may be one resulting from operation of the system, or from external influence on the system. For example, in the case of an oil burning furnace, the third variable might be the oil temperature. In a direct current motor control system, the first variable might be the desired speed setting, the second variable might be the firing angle, and the third variable the load current. Similarly, with an internal combustion engine, the first variable might be fuel supply, the second variable air supply and the third variable engine speed. Thus, in a system of this kind, an additional "layer" of adaptive controllers would be provided, access to each layer being controlled by the instantaneous value of the third value.

Further elaboration into three dimensions is possible in which case a further layer of adaptive controllers is provided under the control of the instantaneous value of a fourth variable.

An alternative method of compensating for changes in oil temperature may be provided in the arrangement shown in FIG. 4. For this purpose, an additional signal may be provided to modify the trim position control signal supplied to the trim positioner 19. The signal may, for example, be applied through an adder inserted in the line between the limiter 29 and the trim positioner 19. Preferably the signal representing changes in oil temperature is applied to the adder through a variable gain amplifier, the gain of which is controlled by the reconstructed untrimmed damper position signal taken, for example, from the output of the comparator 28.

Figure 11:
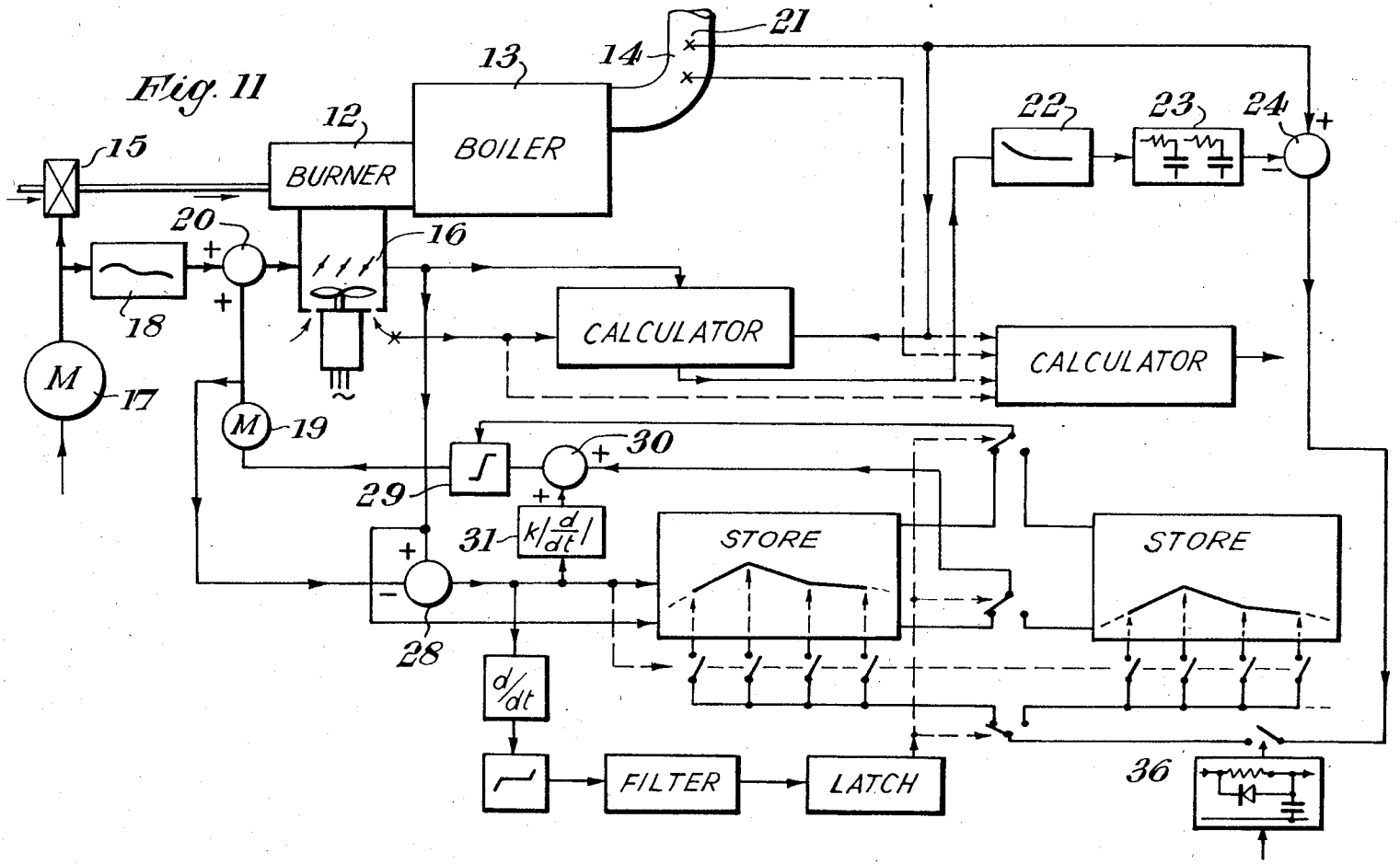
FIG. 11 illustrates a modification of the apparatus illustrated in FIG. 4.

FIG. 11 illustrates an alternative approach that is applicable primarily to removing hysteresis in the fuel flow-control valve. The apparatus illustrated in this Figure includes means for creating two adaptive-trim profiles: one for increasing and the other for decreasing untrimmed-damper movement. The input apportioning and output interpolation both proceed as for the basic adaptive-trim unit, but input to and output from these profile-integrators/controllers are switched to the one set of profile-generators for increasing, and to the other set for decreasing untrimmed damper position ($D_o$), as indicated in FIG. 11. Control of the switch-action is from $d(D_o)/dt$, which requires to be greater than a (small) threshold-level. This threshold level is needed in order to allow for noise-levels in $D_o$, which could otherwise cause continuous oscillation between the two adaptive profiles. A preferred switching-strategy may be to detect that a given minimum-magnitude change in $D_o$ has taken place over a given short period of time: the effect is the same as $d(D_o)/dt$ controlled switching with the given threshold $d(D_o)/dt$ having to be exceeded for the given short time period—in effect a form of filtering against spurious operation of the switch-action.

At first analysis, the foregoing technique may appear to suffer badly from the fact that operation can in reality exist anywhere between the two adaptive-profiles; also a 'flip' action can possibly occur across the hysteretic characteristic at a somewhat indeterminate point. However, the situation, while imperfect, can in practice show worthwhile improvement, mainly because changes in demanded burn-rate (and hence $D_o$) are frequently found to consist of relatively large steps with no movement in between these changes, this being due to the rather crude, (ON/OFF proportioning plus dead-band) nature of the steam/water temperature controllers that are normally fitted.

Advantages of the scheme are its greater simplicity, and the fact that hysteresis from *all* sources is corrected: in particular, hysteresis within the oil-flow valve (which would not be corrected by measuring its position) is corrected by the foregoing technique, within the limits of its restricted capabilities.

The scheme can be operated, as can the other adaptive-trim or adaptive-profile schemes, using airflow instead of damper-position measurement: in which case allowance must be made (if necessary) for the non-availability of an 'untrimmed-airflow' measurement.

Due to hysteresis (in the profiler) the reconstructed untrimmed damper signal can be in error, with the result in particular that oscillation could occur across a high negative slope for the adapted-trim profile. (If selection of the adaptive-trim-profile were to be for actual damper position, oscillation could take place over a high positive slope). A cure for this condition can be provided by placing a limit on the maximum slope of the trim-profile; adaption at a particular operating point is contrived/allowed to pull up/down adjacent adaptive-profile integrators/controllers.

We claim:

1. Combustion control apparatus for a burner having a motor-controlled fuel valve and motor-controlled means for adjusting the supply of air to said burner as the burn-rate is varied by said fuel valve, said apparatus comprising: means for measuring a characteristic of the flue gas of said burner; means for comparing the measured value of said characteristic with a desired value and producing an error signal representing the difference between said measured value and said desired value; means for storing a plurality of control signals each representing a value of the air supply associated with a respective burn-rate and for continuously updating said control signals by varying them in dependence on said error signal in the direction necessary to reduce said error signal towards zero; means for continuously selecting the appropriate control signal in dependence on the instantaneous burn-rate; a mechanical profiler controlled by the motor operating the fuel valve and adapted to control a damper to effect a coarse variation of the air supply in dependence on the desired burn-rate; and apparatus controlled by said selected control signal adapted to trim the output of the mechanical profiler and thus to adjust the air supply in the direction necessary to reduce said error signal towards zero; wherein said means for storing comprises a plurality of individual storage locations, each adapted to store a value of the trim position required for a particular value of burn-rate, said stored values being continuously updated by means of said error signal; wherein said means for selecting comprises a first selector adapted to apply proportions of said error signal to two adjacent storage locations in dependence on an output signal representing the output of said mechanical profiler, and a second selector adapted to supply proportions of the contents of two adjacent storage locations to said trim apparatus again in dependence on said output signal; wherein said output signal is constructed by subtracting a signal representing the output of the trim apparatus from a signal measuring the actual damper position; said combustion control apparatus further comprising means for calculating the burn-rate in dependence on said signal measuring the actual damper position, a signal measuring the oxygen content of the flue gas, and a signal measuring the inlet air temperature in the burner.

2. Combustion control apparatus for a burner having a motor-controlled fuel valve and motor-controlled means for adjusting the supply of air to said burner as the burn-rate is varied by said fuel valve, said apparatus comprising: means for measuring a characteristic of the flue gas of said burner; means for comparing the measured value of said characteristic with a desired value and producing an error signal representing the difference between said measured value and said desired value; means for storing a plurality of control signals each representing a value of the air supply associated with a respective burn-rate and for continuously updating said control signals by varying them in dependence on said error signal in the direction necessary to reduce said error signal towards zero; means for continuously selecting the appropriate control signal in dependence on the instantaneous burn-rate; a mechanical profiler controlled by the motor operating the fuel valve and adapted to control a damper to effect a coarse variation of the air supply in dependence on the desired burn-rate; and apparatus controlled by said selected control signal adapted to trim the output of the mechanical profiler and thus to adjust the air supply in the direction necessary to reduce said error signal towards zero; wherein said means for storing comprises a plurality of individual storage locations, each adapted to store a value of the position of the damper required for a particular value of burn-rate, said storage values being continuously updated by means of said error signal; wherein said means for selecting comprises a first selector adapted to apply proportions of said error signal to two adjacent storage locations in dependence on a signal representing the position of the fuel valve, and a second selector adapted to supply proportions of the contents of the two adjacent storage locations to an error amplifier circuit again in dependence on said signal representing the position of the fuel valve, and wherein a further signal representing the actual position of the damper is supplied to said error amplifier circuit, the output of which is fed to a feedback controller which controls the trim position.

3. Combustion control apparatus for a burner having a motor-controlled fuel valve and motor-controlled means for adjusting the supply of air to said burner as the burn-rate is varied by said fuel valve, said apparatus comprising: means for measuring a characteristic of the flue gas of said burner; means for comparing the measured value of said characteristic with a desired value and producing an error signal representing the difference between said measured value and said desired value; means for storing a plurality of control signals each representing a value of the air supply associated with a respective burn-rate and for continuously updating said control signals by varying them in dependence on said error signal in the direction necessary to reduce said error signal towards zero; means for continuously selecting the appropriate control signal in dependence on the instantaneous burn-rate; a mechanical profiler controlled by the motor operating the fuel valve and adapted to control a damper to effect a coarse variation of the air supply in dependence on the desired burn-rate; and means for applying said selected control signal to adjust the supply of air or said fuel valve in the direction necessary to reduce said error signal towards zero; a limits profiler controlled by the motor operating the fuel valve; a motor controlling a damper to adjust the supply of air; and a feedback controller, the input to which depends on the difference between the selected control signal and a signal representing the actual position of the damper, and the outputs of which are passed to the damper motor through limit means controlled by the limits profiler.

4. Combustion control apparatus for a burner having a motor-controlled fuel valve and motor-controlled means for adjusting the supply of air to said burner as the burn-rate is varied by said fuel valve, said apparatus comprising: means for measuring a characteristic of the flue gas of said burner; means for comparing the measured value of said characteristic with a desired value and producing an error signal representing the difference between said measured value and said desired value; means for storing a plurality of control signals each representing a value of the air supply associated with a respective burn-rate and for continuously updating said control signals by varying them in dependence on said error signal in the direction necessary to reduce said error signal towards zero; means for continuously selecting the appropriate control signal in dependence on the instantaneous burn-rate; a mechanical profiler controlled by the motor operating the fuel valve and adapted to control a damper to effect a coarse variation of the air supply in dependence on the desired burn-rate; and apparatus controlled by said selected control signal adapted to trim the output of the mechanical profiler and thus to adjust the air supply in the direction necessary to reduce said error signal towards zero; wherein said means for storing comprises a plurality of individual storage locations, each adapted to store a value of the trim position required for a particular value of burn-rate, said stored values being continuously updated by means of said error signal; said combustion control apparatus further comprising means for adding to said selected control signal before it is applied to said trim apparatus an additional signal representing changes in fuel temperature.

5. Combustion control apparatus according to claim 1, wherein the measured characteristic is the oxygen content of the flue gas, and wherein the apparatus comprises means for generating a signal representing the desired oxygen value at each burn-rate.

6. Combustion control apparatus according to claim 1, comprising means for calculating the desired value of oxygen in dependence on said calculated burn-rate.

7. Combustion control apparatus according to claim 6, including means for compensating for time delays in the operation of the burner, connected between said means for calculating the desired value of oxygen and said means for comparing.

8. Combustion control apparatus according to claim 1, comprising a limiter connected between said second selector and said trim apparatus.

9. Combustion control apparatus according to claim 8, comprising means for adding a signal proportional to the rate of change of the signal representing the output from the mechanical profiler to the output of said second selector.

10. Combustion control apparatus according to claim 1, whrein said means for storing comprises a plurality of integrators.

11. Combustion control apparatus according to claim 1, wherein said means for storing comprises a plurality of three-term controllers.

12. Combustion control apparatus according to claim 4, wherein said additional signal is applied to said adding means through a variable gain amplifier, the gain of which is controlled by the untrimmed damper position signal.

13. Combustion control apparatus according to claim 1, wherein said means for storing comprises two pluralities of individual storage locations, wherein each of the storage locations in one of said pluralities is adapted to store a value of the trim position required for a particular value of burn-rate when the air supply is increasing, and wherein each of the storage locations in said other plurality is adapted to store a value of the trim position required for a particular value of burn-rate when the air supply is decreasing, means being provided to switch to one plurality or the other plurality in accordance with whether the air supply is increasing or decreasing.

* * * * *